US006030522A

United States Patent [19]

Pereira et al.

[11] Patent Number: 6,030,522

[45] **Date of Patent: *Feb. 29, 2000**

[54] COMBINED STEAM CONVERSION PROCESS FOR TREATING VACUUM GAS OIL

[75] Inventors: Pedro Pereira; Trino Romero, both of San Antonio de los Altos; Jose Velasquez; Alfonso Tusa, both of Los Teques; Iraima Rojas, San Antonio de los Altos; William Camejo, Los Teques; Marcos Rosa-Brussin, Caracas, all of Venezuela

[73] Assignee: Intevep, S.A., Caracas, Venezuela

[ * ] Notice: This patent is subject to a terminal disclaimer.

[21] Appl. No.: 09/260,108

[22] Filed: Mar. 2, 1999

Related U.S. Application Data

[63] Continuation-in-part of application No. 08/838,834, Apr. 11, 1997, Pat. No. 5,885,441.

[51] Int. Cl.[7] ..... C01G 13/02

[52] U.S. Cl. ..... 208/130; 208/121; 208/124; 208/153

[58] Field of Search ..... 208/130, 121, 208/124, 153; 502/226

[56] References Cited

U.S. PATENT DOCUMENTS 5,688,395 11/1997 Carrazza et al. ..... 208/130
5,885,441 3/1999 Perrira et al. ..... 208/130

*Primary Examiner*—Helane Myers
*Attorney, Agent, or Firm*—Bachman & LaPointe, P.C.

[57] ABSTRACT

A process for upgrading a heavy hydrocarbon feed includes the steps of: providing a hydrocarbon feedstock including a fraction having a boiling point greater than or equal to about 320° C.; mixing the feedstock with steam so as to provide a reaction feedstock; providing a catalyst including a first metal selected from the group consisting of Group VIII non-noble metals and a second metal selected from the group consisting of alkali metals, the first and second metals being supported on a support selected from the group consisting of kaolin, alumina, silica, carbon, petroleum cokes and mixtures thereof; and contacting the reaction feedstock with the catalyst at steam conversion conditions so as to provide a reaction product including an upgraded hydrocarbon fraction.

14 Claims, 1 Drawing Sheet

COMBINED STEAM CONVERSION PROCESS FOR TREATING VACUUM GAS OIL

CROSS REFERENCE TO RELATED APPLICATION

This application is a continuation-in-part of co-pending U.S. patent application Ser. No. 08/838,834, now U.S. Pat. No. 5,885,441 filed Apr. 11, 1997.

BACKGROUND OF THE INVENTION

Certain heavy hydrocarbon feedstocks, such as vacuum gas oil (VGO), are conventionally treated using a fluid catalytic cracking (FCC) procedure so as to obtain some fraction of the feedstock as an upgraded product. One particularly desirable upgraded fraction which can be obtained using FCC processing is a light crude oil (LCO). However, conventional FCC processing provides only a small conversion to LCO, for example, about 15% of the feedstock.

It is therefore the primary object of the present invention to provide a steam conversion process wherein heavy hydrocarbon feedstock such as VGO can be treated so as to obtain increased fractions of desirable products, especially LCO.

It is a further object of the invention to provide a process whereby vacuum gas oil can be converted to valuable products.

Other objects and advantages of the invention will appear herein below.

SUMMARY OF THE INVENTION

In accordance with the invention, the foregoing objects and advantages are readily attained.

According to the invention, a process for upgrading a heavy hydrocarbon feed is provided, which process comprises the steps of providing a hydrocarbon feedstock comprising a fraction having a boiling point greater than or equal to about 320° C.; mixing said feedstock with steam so as to provide a reaction feedstock; providing a catalyst comprising a first metal selected from the group consisting of Group VIII non-noble metals and a second metal selected from the group consisting of alkali metals, said first and second metals being supported on a support selected from the group consisting of kaolin, alumina, silica, carbon, petroleum coke and mixtures thereof; and contacting said reaction feedstock with said catalyst at steam conversion conditions so as to provide a reaction product including an upgraded hydrocarbon fraction.

In further accordance with the present invention, a process is provided wherein said reaction product includes said upgraded hydrocarbon fraction and a liquid residue, and further comprising the steps of feeding said liquid residue to a fluid catalytic cracking zone to obtain an FCC upgraded hydrocarbon fraction.

In still further accordance with the present invention, a process is provided for upgrading a heavy hydrocarbon feed which includes steam conversion using a catalyst in accordance with the present invention followed by conventional FCC treatment, and which provides a final product including LCO fractions which are greater than can be obtain using only FCC treatment.

BRIEF DESCRIPTION OF THE DRAWINGS

A detailed description of preferred embodiments of the invention follows, with reference to the attached drawings, wherein.

DETAILED DESCRIPTION

Figure 1:
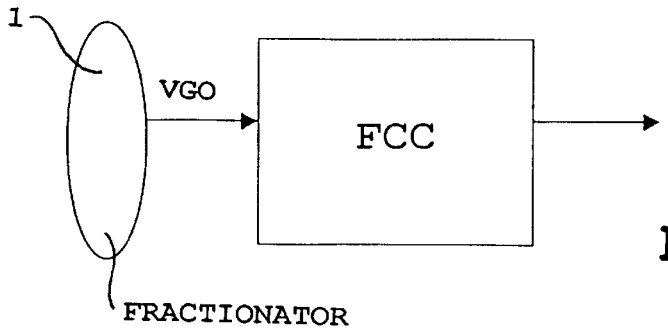
FIG. 1 is a schematic representation of typical VGO processing through an FCC process.

The invention relates to a steam conversion process for use in upgrading a heavy hydrocarbon feedstock, especially for upgrading a vacuum gas oil (VGO) feedstock, and particularly to a process which provides improved quality products as compared to conventional fluid catalytic cracking (FCC) treatment of the same feedstock.

A typical feedstock for use in treatment in accordance with the process of the present invention preferably includes a fraction boiling at a temperature of at least about 320° C., and a typical VGO feedstock is described below in Table 1.

TABLE 1

Feedstock (VGO) Composition

| Analysis | |
|---|---|
| API gravity | 17.4–19.8 |
| Total Nitrogen (ppm) | 1713–1716 |
| Viscosity @ 140° F. | 75–103.9 |
| Res. $\mu$C (%) | 0.5–0.91 |
| Sulfur (%) | 1.92–2.08 |
| Carbon (%) | 85.5–85.71 |
| Hydrogen (%) | 11.3–11.7 |
| Aromatics (%) | 54.7–56.6 |
| Simulated Distillation (%) | |
| IBP | 353 |
| 5 | 399 |
| 10 | 418 |
| 30 | 456 |
| 50 | 483 |
| 70 | 510 |
| 90 | 549 |
| 95 | 570 |
| FBP | 630 |

Such a feedstock is a good candidate for treatment according to the invention so as to convert to final product including a fraction as a light crude oil (LCO) which is a commercially valuable and desirable product itself, or for further processing.

In accordance with the present invention, such a feedstock is treated by mixing with steam so as to provide a reaction feedstock and contacting the reaction feedstock with a catalyst comprising a first metal selected from the group consisting of Group VIII non-noble metals and a second metal which is an alkali metal. The reaction feedstock and catalyst are contacted at steam conversion conditions so as to provide a reaction product which includes an upgraded hydrocarbon fraction comprising naphtha and light crude oil (LCO).

The reaction product also typically includes a liquid residue comprising unconverted vacuum gas oil, which is then fed to a conventional fluid catalytic cracking (FCC) process in accordance with the present invention so as to provide a further reaction product including an FCC upgraded fraction also comprising naphtha and LCO, and a balance containing other products. In accordance with the present invention, the aggregate conversion to LCO and naphtha obtained by the combined steam conversion and FCC processes is greater than conversion to such product obtained using FCC processing alone. Advantageously, this increase is obtained while having little effect on total naphtha produced, and while maintaining coke production substantially constant.

In accordance with the present invention, the catalyst used for the steam conversion step may suitably be provided in solid, oil soluble or emulsion form. For example, the catalyst may be provided in emulsion form as disclosed in co-pending parent application Ser. No. 08/838,834.

It is most preferred that the catalyst be provided as a solid catalyst with the desired first and second metals supported on a support. The support is preferably selected from the group consisting of kaolin, alumina, silicon, carbon, petroleum coke and mixtures thereof, most preferably kaolin, alumina and mixtures thereof.

The first metal of the catalyst is preferably selected from the group consisting of Group VIII non-noble metals, and is most preferably selected from the group consisting of iron, cobalt, nickel and mixtures thereof.

The second metal of the catalyst is preferably an alkali metal, more preferably sodium, potassium, cesium or mixtures thereof.

The solid catalyst preferably has a surface area of between about 10 $m^2/g$ and about 800 $m^2/g$, most preferably between about 75 $m^2/g$ and about 80 $m^2/g$, a pore volume of between about 0.12 cc/g and about 0.60 cc/g, most preferably between about 0.47 cc/g and about 0.60 cc/g, and pore size of between about 5 Å and about 2000 Å, most preferably between about 86 Å and about 90 Å. The catalyst is also preferably provided having a ratio by weight of first metal to second metal supported on the catalyst of between about 0.2 and about 4, and having a total metal content of between about 2% (wt.) and about 15% (wt.).

The process of the present invention includes contacting the desired catalyst with the VGO feedstock at steam conversion conditions. The preferred steam conversion conditions include a pressure of between about 50 psig and about 500 psig, a space velocity of between about 0.1 $h^{-1}$ and about 4.0 $h^{-1}$, a temperature of between about 400° C. and about 480° C. and a molar ratio of $H_2O$ to feedstock of between about 0.5 and about 10.0.

Steam conversion using the solid catalyst as described above can advantageously be carried out in a conventional tubular reactor, for example in an upward flow through a bed of the desired catalyst. The product from this reaction step will include an upgraded or light fraction comprising naphtha and LCO.

The total product from the reactor is then introduced to a distillation process or unit, where an initial fraction of naphtha and LCO is recovered, and a residual vacuum gas oil is collected and fed to an FCC process. The FCC process will provide an FCC product including an additional fraction of naphtha and LCO, and the combined production of LCO using the initial steam conversion and subsequent FCC processing is substantially increased as compared to FCC processing alone. This will be demonstrated in the examples set forth below.

The solid catalyst as described above may suitably be prepared through either co-impregnation or consecutive impregnation methods by adding aqueous solutions of at least one transition metal selected from group VIII of the periodic table of elements, and/or alkali metal solutions over the support, followed by drying and calcining. Prior to use in steam conversion, it is preferred that this catalyst be pretreated using a flow of steam and an inert gas, preferably at a temperature of between about 250° C. and about 480° C., more preferably about 450° C., at a ratio by volume of $H_2O$ to inert gas of between about 0.01 and about 1, for a period of between about 0.1 and about 2 hours.

For example, one preferred catalyst in accordance with the present invention is a catalyst having nickel oxide and potassium oxide supported on kaolin. Such a catalyst may suitably be prepared by impregnating kaolin with an aqueous solution of potassium nitrate, drying the impregnated kaolin at about 120° C. and calcining the dried kaolin at a temperature of about 450° C. for about 5 hours. The resulting solid is then impregnated with a second solution of nickel nitrate ($Ni(NO_3)_2.6H_2O$), dried at a temperature of about 120° C., and calcined at about 450° C. for another 5 hours. The resulting NiO—$K_2O$/kaolin catalyst provides excellent results in processing in accordance with the present invention.

Of course, as set forth above, alternate catalyst such as emulsion or oil soluble catalysts may be used in accordance with the process of the present invention. It is preferred, however, and more advantageous results are obtained, by using the solid catalyst as disclosed above.

Table 2 below sets forth standard ranges of operating conditions in connection with the process of the present invention.

TABLE 2

| Operating Conditions | |
|---|---|
| HVGO Flow (g/h) | 6.0–9.1 |
| $H_2O$ Flow (g/h) | 0.84–3.3 |
| $N_2$ Flow (cc/min) | 7.8–18.2 |
| Ratio $H_2O$/HVGO (molar) | 0.54–6.3 |
| Reacting Temperature (° C.) | 420–450 |
| WHSV ($h^{-1}$) | 0.91–2.5 |
| Total pressure (psig) | 150–370 |
| Mass catalyst (g) | 6.0–10.0 |
| Running time (min) | 15–1440 |

Figure 2:
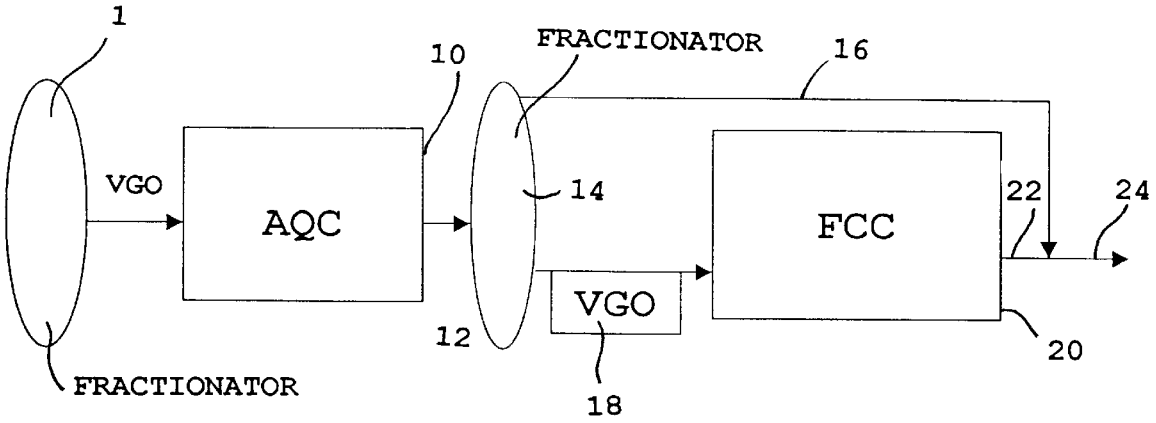
FIG. 2 is a schematic representation of a process in accordance with the present invention.

Referring now to the drawings, FIGS. 1 and 2 illustrate the process of the present invention as compared to conventional FCC processing.

FIG. 1 is a simple schematic illustration of a VGO feed from a fractionator 1 to an FCC processing system.

FIG. 2 schematically shows the process of the present invention, wherein the same VGO feedstock obtained from a fractionator 1 is fed first to a steam conversion (AQC) process 10. The steam conversion process 10 results in a product 12 which is fed to a vacuum fractionator 14 wherein an upgraded fraction 16 comprising LCO and naphtha is obtained, as well as a residual VGO 18. Residual VGO 18 is fed to an FCC process 20, where additional LCO and naphtha are produced. The product 22 of the FCC process can then be blended back with the LCO and naphtha fraction 16 to provide a total upgraded product 24 including an LCO fraction which is substantially increased as compared to that provided using FCC processing alone.

EXAMPLE 1

This example illustrates operation of the process of the present invention for conversion of vacuum gas oil (VGO) as set forth in Table 1 above, using steam and 6 grams of solid catalyst containing 2% (wt.) nickel and 4% (wt.) potassium supported on kaolin, wherein the nickel and potassium is measured based on weight of the catalyst. The catalyst was used in a fixed bed tubular reactor at a space velocity (WHSV) of 1.0 $h^{-1}$. The process conditions included a pressure of 260 psig, running time of 8 hours, steam flow of 1.7 cc/h, feedstock flow of 6.0 g/h and temperatures of 425° C., 435° C. and 450° C. Table 3 set forth below contains the conversion results obtained for each of these temperatures.

TABLE 3

| Temperature (° C.) | 425 | 435 | 450 |
|---|---|---|---|
| Gas (% wt/wt) | 2.04 | 3.32 | 6.77 |
| Coke (% wt/wt) | 3.28 | 2.36 | 3.19 |

TABLE 3-continued

| | | | |
|---|---|---|---|
| Yield 360° C. (% wt/wt) | 51.77 | 59.87 | 55.60 |
| Conversion 360 + ° C. (% wt/wt) | 55.50 | 65.64 | 74.90 |
| Conversion 520 + ° C. (% wt/wt) | 54.91 | 91.30 | 32.48 |
| Balance (%) | 99.98 | 99.52 | 99.45 |

As set forth above, excellent conversion is provided at each of the temperatures indicated. For example, at an operating temperature of 435° C., the process of the present invention produces a 3.2% gas yield, a product yield at 360° C. of 59.87%, conversion of the 360° C.+residue fraction of 65.64% and conversion of the 520° C.+residue fraction of 91.30%. The coke production was small as desired.

EXAMPLE 2

This example shows the excellent results of the process of the present invention including a steam conversion followed by FCC treatment (AQC–VGO process+FCC) as compared to FCC treatment by itself (FCC Process). This example was carried out using the same feedstock as identified in Table 1 above.

This feedstock was treated in accordance with the present invention using a steam conversion process at 425° C. and 435° C. and using the same catalyst as set forth above in Example 1. Process conditions included a total pressure of 260 psig, a WHSV of 1 $h^{-1}$, and a mass of catalyst of 6 g.

Tables 4 and 5 set forth the results of this comparison.

TABLE 4

Comparison between the AQC-VGO + FCC process vs. the FCC process

| Products (% wt/wt) | FCC Process | AQC-VGO 425° C. | Process + FCC 435° C. |
|---|---|---|---|
| Gas (dry + LPG)) | 22.02 | 10.92 | 9.87 |
| Naphtha | 43.90 | 38.98 | 39.72 |
| LCO | 16.57 | 33.28 | 33.41 |
| HCO | 11.58 | 10.44 | 10.34 |
| Coke | 5.93 | 6.38 | 6.67 |
| Balance | 100.00 | 100.00 | 100.00 |

TABLE 5

Comparison between AQC-VGO process + FCC vs. FCC process

| Naphtha and LCO<br>Naphtha ($C_{13}^{-}$fraction)<br>Wt/wt (%) | FCC Process | AQC-VGO + FCC Process |
|---|---|---|
| Paraffins | 4.97 | 5.08 |
| Isoparaffins | 21.35 | 12.03 |
| Olefins | 13.75 | 7.84 |
| Naphthenes | 7.41 | 4.57 |
| Aromatics | 52.30 | 70.47 |
| Naphtha | | |
| RON | 88.2 | 82.7 |
| MON _ | 80.6 | 77.0 |
| LCO | | |
| Aromatics (%) | | 34.4 |
| Mono-aromatics | | 75.0 |
| Saturate | | 65.6 |
| Cetane index | 31.0 | 40.6 |

In the above tables, the process of the present invention is referred to as AQC–VGO+FCC process, and the conventional FCC processing is referred to as FCC process.

Referring to Table 4, processing in accordance with the present invention at 435° C. advantageously decreased the production of gas (dry+LPG) from 22.02% (wt.) to 9.98% (wt.), naphtha production was decreased slightly by about 4.8% (wt.), and HCO production remains substantially constant. However, the process of the present invention provided a substantial increase of LCO, from 16.57% (wt.) with the FCC process alone, to 33.41% (wt.) using the combined process of the present invention. A marginal increase of coke production in the range of 0.74% (wt.) was also experienced.

As set forth in Table 4, the process of the present invention also provided for an increase in the aromatic fraction of about 18.2% (wt.), from 52.30% to 70.47%. The process of the present invention did result in a reduction in RON and MON from 88.2 to 82.6 and from 80.6 to 77.0, respectively. However, the process of the present invention also provided an LCO fraction that has a cetane index of 40.6 compared to 31.0 for the cetane index of the FCC process and having an aromatic content of 34.4%, 75% of which was monoaromatics. In addition, the LCO provided in accordance with the present invention contained 65.6% (wt.) of saturated hydrocarbons.

In accordance with the foregoing, it is clear that the process of the present invention compares favorably to that of FCC processing alone.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed:

1. A process for upgrading a heavy hydrocarbon feed, comprising the steps of:

providing a hydrocarbon feedstock comprising a fraction having a boiling point greater than or equal to about 320° C.;

mixing said feedstock with steam so as to provide a reaction feedstock;

providing a catalyst comprising a first metal selected from the group consisting of Group VIII non-noble metals and a second metal selected from the group consisting of alkali metals, said first and second metals being supported on a support selected from the group consisting of kaolin, alumina, silica, carbon, petroleum coke and mixtures thereof; and contacting said reaction feedstock with said catalyst at steam conversion conditions so as to provide a reaction product including an upgraded hydrocarbon fraction.

2. A process according to claim 1, wherein said support is selected from the group consisting of kaolin, alumina and mixtures thereof.

3. A process according to claim 1, wherein said reaction product includes said upgraded hydrocarbon fraction and a liquid residue, and further comprising the steps of feeding said liquid residue to a fluid catalytic cracking zone to obtain an FCC upgraded hydrocarbon fraction.

4. A process according to claim 3, wherein said hydrocarbon feedstock is a vacuum gas oil, and wherein said liquid residue is a vacuum gas oil residue.

5. A process according to claim 4, wherein said upgraded hydrocarbon fraction and said FCC upgraded hydrocarbon fraction comprise naphtha and light crude oil.

6. A process according to claim 1, wherein said contacting step is carried out at a space velocity of between about 0.1 $h^{-1}$ and about 4.0 $h^{-1}$.

7. A process according to claim 1, wherein said steam conversion conditions include a pressure of between about 50 psig and about 500 psig, a temperature of between about 400° C., and about 480° C., a molar ratio of $H_2O$ to feedstock of between about 0.5 and about 10.0, and a space velocity of between about 0.1 $h^{-1}$ and about 4.0 $h^{-1}$.

8. A process according to claim 1, wherein said first metal is selected from the group consisting of iron, cobalt, nickel and mixtures thereof.

9. A process according to claim 1, wherein said second metal is selected from the group consisting of sodium, potassium, cesium and mixtures thereof.

10. A process according to claim 1, wherein said catalyst has a surface area of between about 10 $m^2/g$ and about 800 $m^2/g$, a pore volume of between about 0.12 cc/g and about 0.60 cc/g, and a pore size of between about 5 Å and about 2000 Å.

11. A process according to claim 1, wherein said catalyst has a surface area of between about 75 $m^2/g$ and about 80 $m^2/g$.

12. A process according to claim 1, wherein said catalyst has a pore volume of between about 0.47 cc/g and about 0.50 cc/g.

13. A process according to claim 1, wherein said catalyst has a pore size of between about 86 Å and about 90 Å.

14. A process according to claim 1, further comprising the step of pretreating said catalyst, prior to said contacting step, by contacting said catalyst with steam and nitrogen at a temperature of between about 250° C. and about 480° C. and a ratio of $H_2O$ to inert gas of between about 0.01 and about 1 for between about 0.1 hour and about 2.0 hours.

* * * * *